US006490894B1

(12) United States Patent
Laurent

(10) Patent No.: US 6,490,894 B1
(45) Date of Patent: Dec. 10, 2002

(54) DEVICE FOR MOUNTING A VEHICLE DOOR OPENING CONTROL

(75) Inventor: Arquevaux Laurent, Sully sur Loire (FR)

(73) Assignee: Meritor Light Vehicle Systems-France, Sully sur Loire (FR)

( * ) Notice: Subject to any disclaimer, the term of this patent is extended or adjusted under 35 U.S.C. 154(b) by 0 days.

(21) Appl. No.: 09/377,659

(22) Filed: Aug. 19, 1999

(30) Foreign Application Priority Data

Aug. 19, 1998 (FR) ..... 98 10556

(51) Int. Cl.[7] ..... E05B 13/00

(52) U.S. Cl. ..... 70/208; 70/370; 70/451; 70/452; 70/466; 292/336.3; 292/DIG. 31

(58) Field of Search ..... 70/208, 370, 210, 70/451, 452, 466; 292/DIG. 31, 352, DIG. 53, 336.3

(56) References Cited

U.S. PATENT DOCUMENTS

| | | | | | |
|---|---|---|---|---|---|
| 1,040,764 | A | * | 10/1912 | Rose | 292/302 X |
| 2,040,258 | A | * | 5/1936 | Jacobi | 70/370 |
| 3,868,836 | A | * | 3/1975 | La Roche | 70/370 X |
| 4,038,718 | A | * | 8/1977 | Reilhac et al. | 292/DIG. 31 X |
| 4,619,123 | A | * | 10/1986 | Hill | 70/418 X |
| 4,838,590 | A | * | 6/1989 | Isomura | 292/DIG. 31 X |
| 4,872,366 | A | * | 10/1989 | Appelby et al. | 292/DIG. 31 X |
| 4,875,726 | A | * | 10/1989 | Thau | 292/DIG. 31 X |
| 5,005,885 | A | * | 4/1991 | Kobayashi et al. | 292/DIG. 31 X |
| 5,095,659 | A | * | 3/1992 | Benoit et al. | 292/DIG. 31 X |
| 5,129,694 | A | * | 7/1992 | Tanimoto et al. | 292/DIG. 31 X |
| 5,176,016 | A | * | 1/1993 | Hill | 70/417 |
| 5,183,302 | A | * | 2/1993 | Pelachyk et al. | 292/DIG. 31 X |
| 5,282,657 | A | * | 2/1994 | Clinch et al. | 292/DIG. 31 X |
| 5,499,851 | A | * | 3/1996 | Mitchell | 292/DIG. 31 X |
| 5,531,489 | A | | 7/1996 | Cetnar | 292/225 |
| 5,551,268 | A | * | 9/1996 | Carnes et al. | 70/370 |
| 5,558,372 | A | * | 9/1996 | Kapes et al. | 292/DIG. 31 X |
| 5,987,943 | A | * | 11/1999 | Verga et al. | 70/208 |
| 6,059,329 | A | * | 5/2000 | Spitzley | 292/DIG. 31 X |

FOREIGN PATENT DOCUMENTS

| | | | | |
|---|---|---|---|---|
| DE | 3030519 | | 2/1982 | |
| DE | 19619869 | | 12/1996 | |
| EP | 0204605 | * | 12/1986 | 70/370 |
| EP | 0276972 | | 8/1988 | |
| EP | 0390669 | * | 10/1990 | 70/370 |
| EP | 0816604 | | 1/1998 | |
| FR | 2606446 | * | 5/1988 | 70/455 |
| JP | 403157223 | * | 7/1991 | 292/DIG. 31 |

* cited by examiner

*Primary Examiner*—Lloyd A. Gail
(74) *Attorney, Agent, or Firm*—Carlson, Gaskey & Olds

(57) ABSTRACT

The device is intended for a door having an exterior door panel having a door aperture and an edge face extending perpendicular to the exterior door panel. According to the invention, the device comprises an intermediate mounting plate borne by a support plate between it and the exterior door panel, the support plate carrying connecting elements. The device further includes an outside opening control module for opening the door from outside the vehicle. The intermediate mounting plate and the outside opening control module have cooperating attachment components for securing the control module to the intermediate support plate and for securing and pre-positioning the connecting elements in order to provide a connection between the control module and a lock. The device is intended to optimize the process of assembling automobile doors.

14 Claims, 2 Drawing Sheets

DEVICE FOR MOUNTING A VEHICLE DOOR OPENING CONTROL

BACKGROUND OF THE INVENTION

This invention relates to devices for mounting elements that allow vehicle doors, particularly automobile doors, to be opened and closed.

Currently, the mounting of vehicle door opening control elements and, more generally, of all the elements fitted to automobile doors, is lengthy and painstaking due to the excessive number of parts associated with these elements. Furthermore, the order in which mounting is to be performed is complex, thereby limiting the number of operations that can be performed in a specialist workshop at a site that is distant, or even remote, from the site of the vehicle production line.

Thus, there exists a need for a mounting device that allows a reduction in the number of elements associated with the vehicle door opening control and in the number of operations to be performed on the vehicle production line.

SUMMARY OF THE INVENTION

A device for mounting a vehicle door opening control includes an exterior door panel having a door aperture, a door edge face positioned perpendicular to the exterior door panel, and an equipment module having a support plate and equipment elements borne by the support plate. The mounting device comprises an outside opening control module having an opening component for opening the door from outside the vehicle and an attachment component on an inside surface thereof. The mounting device further comprises an intermediate mounting plate, borne by the module support plate between it and the exterior panel, and having an attachment cooperating component for cooperating with the attachment component of the outside opening control module to secure it to the exterior door panel at the door aperture. The intermediate mounting plate also comprises a locating element for positioning the equipment elements to enable connection of the opening component to a lock.

By virtue of this structure, the mounting of the outside opening control module, or handle, known in the art by the name of COO, is made appreciably easier, and the cables or rods for connecting the door lock to the door handle may be supported while at the same time being prepositioned in such a way as to make it easier for their free end to be attached to the outside opening control module.

Other features and advantages of the invention will emerge from the following description of some embodiments of the invention and from the appended drawings.

DETAILED DESCRIPTION OF A PREFERRED EMBODIMENT

Figure 1:
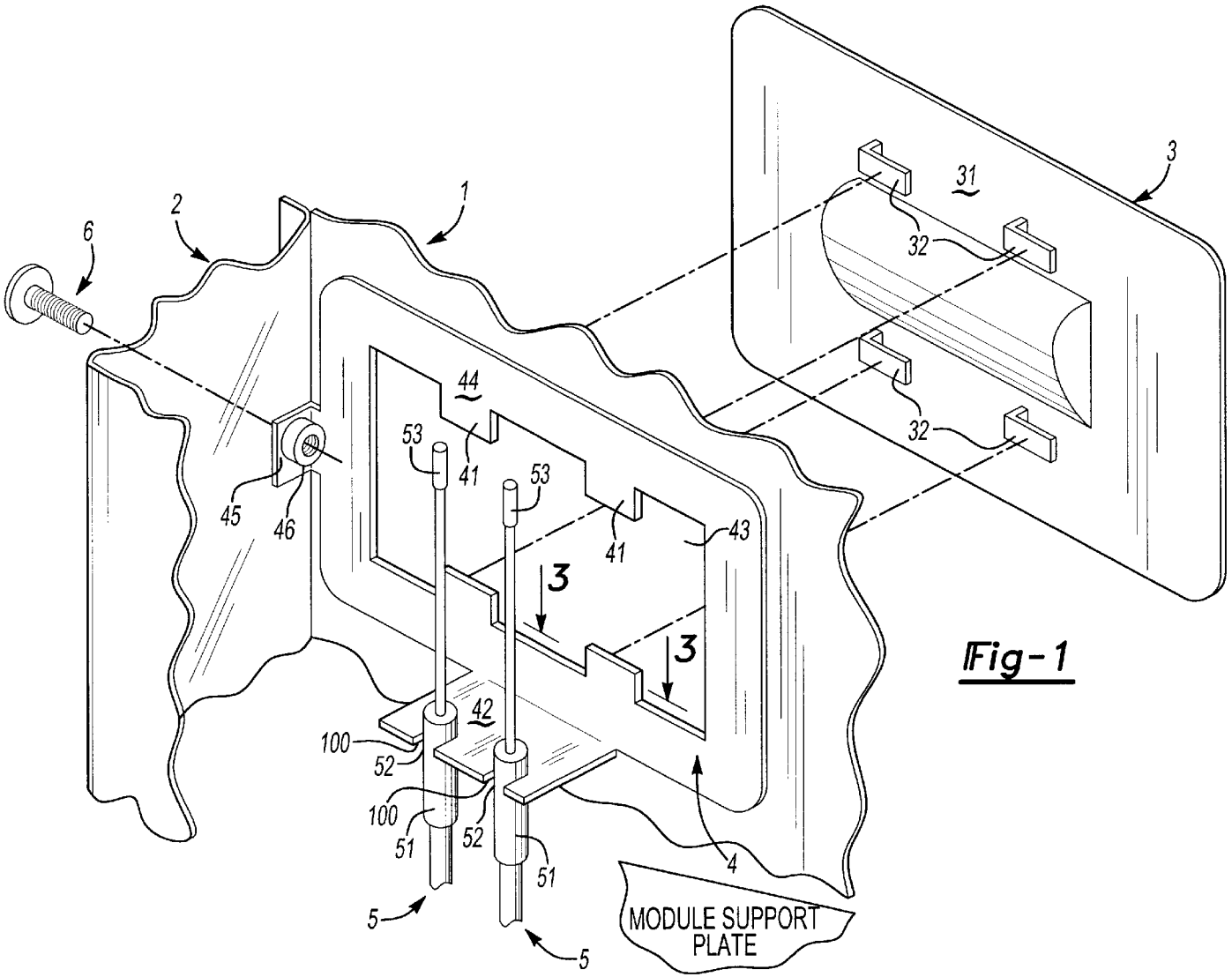
FIG. 1 is a diagrammatic perspective view of a preferred embodiment of a device according to the invention, some of the parts being shown in an "exploded" configuration.
Figure 2:
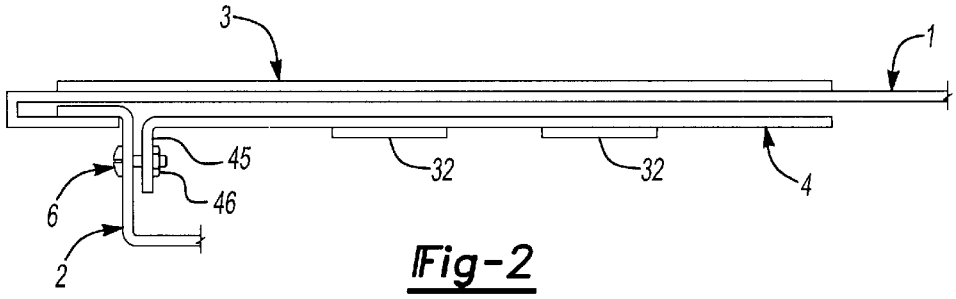
FIG. 2 is a diagrammatic section on a horizontal plane (at right angles to and longitudinal with respect to the mounting plate) showing the overall structure of the device illustrated in FIG. 1.

The device for mounting a vehicle door opening control, one embodiment of which is illustrated in the drawings, is intended to equip a door comprising an exterior door panel 1 and an edge face 2 generally made of sheet metal, part of which is depicted in the figures.

The exterior door panel 1 has an aperture through which is partially inserted a control module 3 for opening a door from the outside having a manual opening component, for example a lever or push-button, and a key-operated opening component (not depicted in the drawings). The outside opening control module 3 comprises a peripheral border 31 intended to be pressed against the panel 1 on the outside and covering the outer edge of the aperture, for aesthetic purposes.

The door also comprises an equipment module, not depicted, comprising a support plate and equipment elements borne by this support plate, particularly, in general, window slideways, a manual and/or electrical window-lifter device, a handle for opening, loudspeakers, the door lock, etc.

According to the invention, the mounting device comprises, apart from the outside opening control module 3, an intermediate mounting plate 4 intended to make the installation, the final attachment and the connection of the control module 3 easier.

This intermediate mounting plate 4 is borne by the module support plate and arranged between it and the exterior panel 1.

The intermediate mounting plate 4 and the outside opening control module 3 each comprise attachment components 32, 41 for securing them together by clipping and/or by clamping as will be seen more specifically later.

The device also comprises connecting elements 5 for connecting the opening component of the outside opening control module 3, in this case the manual opening component and the key-operated opening component, to a lock (not depicted). The connecting elements 5 may be of the flexible-cable or of the linkage (connecting rods) type. In order to secure and to pre-position these elements 5 with respect to the intermediate plate 4, the latter is additionally equipped with an appropriate locating element 42, in this case a support in the form of a lug made of a single piece with the intermediate mounting plate 4, extending at right angles to the plane of the plate 4 and comprising slots 100 for the passage of the connecting elements 5.

The intermediate mounting plate 4 has a rectangular overall shape and is arranged in such a way that its long mid-line is roughly horizontal when the vehicle is standing on approximately horizontal ground. The plate 4 has an aperture 43, also of rectangular overall shape, facing the aperture in the exterior door panel 1, which is intended for the insertion of the outside opening control module 3. A peripheral region 44 of the plate constitutes a closed contour for aperture 43. The attachment component 41 of the intermediate plate 4 consist of tabs extending the peripheral region 44 of the plate 4 inside the generally rectangular-shaped contour of the aperture 43 and, thus, project inwards with respect to the peripheral region 44. These tabs 41 are borne by the two long sides of the peripheral region 44 of the plate 4 and are of rectangular shape. The tabs 41 are arranged in pairs facing each other, and have faces that are at least approximately flat and parallel.

Aside from the fact that it is borne by the module support plate, the intermediate plate 4 is secured to the door by a screw 6, the body of which passes through the edge face 2 of this door and has a screw thread cooperating with a tapped thread in the intermediate plate 4. A vertical side of the peripheral region 44 has a lug 45 extending therefrom at right angles to the overall plane of the plate 4. It is this lug 45 which bears the tapped thread for the thread of the screw 6. The tapped thread is machined directly in a hole in the lug 45, if the lug 45 thickness is sufficient, or in an attached part 46 pierced for this purpose opposite such a hole if the lug 45 is too thin.

In the embodiment depicted in the figures, the intermediate mounting plate 4 is mounted on the module support plate some distance therefrom and in such a way that it can be moved in a parallel translation in one same plane, for example by means of slideways provided in the support plate.

Figure 3:
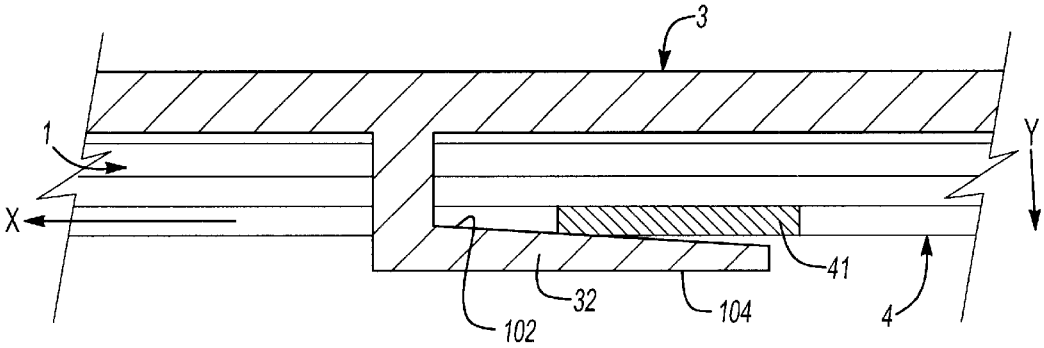
FIG. 3 is a diagrammatic section on a plane which is also horizontal, on the line III—III of FIG. 1, of a detail of the mounting of elements involved in the construction of the embodiment shown in FIG. 1.

The attachment component 32 of the outside opening control module 3 comprises fingers designed to cooperate with one or more tabs 41 of the intermediate plate 4. These fingers are bent into an L borne by an interior face of the outside opening control module 3 that faces towards the inside of the door and are arranged in such a way as to pass through the apertures in the door panel 1 and the intermediate mounting plate 4. These L-shaped fingers 32 have a branch whose opposite end to the bend is connected to the face of the outside opening control module 3 that faces towards the inside of the door, and is at right angles to this face. The other branch of the L-shaped finger 32 has a face designed to come at least partially to face of one of the faces of tab 41 of the intermediate mounting plate 4, which face faces towards the inside of the door. This inside face 102 of the finger 32, which is substantially flat, is inclined with respect to the inside face of the tab 41 and with respect to the face of the outside opening control module 3. The direction of deepest inclination of the inside face of the finger 32 is in a plane at right angles to those of the intermediate plate 4 and of the tapped lug 45. Thus, when the faces, partially facing each other, of the L-shaped fingers 32 of the outside opening control module 3 and of the tabs 41 of the intermediate mounting plate 4 are in contact while this intermediate mounting plate 4 is held in one and the same plane having been secured to the support plate and while the outside opening control module 3 is prevented from moving other than away from or towards the intermediate plate 4 (as a result, for example, of rubbing contact with the exterior door panel), a movement of the intermediate plate 4 in a direction X (FIG. 3), gives rise to a movement of this face of the control module 3 in the direction of the plane of the intermediate mounting plate 4 (direction Y) and causes it to be gripped tightly against the exterior panel 1. The fingers also have an outside face 104.

In order to cause the intermediate mounting plate 4 to move in its own plane, the screw 6 extends along a central horizontal axis parallel to the plane of this plate 4. So, simply turning the screw, the head of which bears against the edge face 2 of the door, and the thread of which is engaged in the tapped thread in the lug 45, causes the intermediate mounting plate 4 to move towards the edge face 2 and causes the control module 3 to be gripped tightly against the exterior door panel 1.

As seen elsewhere, the intermediate plate 4 is equipped with a locating lug 42, at right angles therefrom, comprising slots for the passage of the connecting elements 5. As the purpose is to secure these connecting elements 5 in such a way that they are pre-positioned so that they can be attached to the opening component in a practical way, the connecting elements 5 have an outer sleeve 51 that has an outside diameter or a width, depending on the cross section of the sleeve, that exceeds the width of the corresponding slot in the lug 42, which has a groove 52 inserted in the slot 100 in the lug 42. Thus, the connecting elements 5 are in a fixed position with respect to the intermediate mounting plate 4 and follow this plate in its movement, to cause the region of their free end 53 to attach in a notch in the opening component. In order to allow the length of the connecting elements 5 to protrude above the lug 42 to be adjusted, it is possible to allow for mobility and immobilization of the sleeves 51 along the cables or rods of the connecting elements 5, or with respect to the lug 42 of the intermediate plate 4.

Mounting the outside opening control module 3 using this device is simple because, with the intermediate mounting plate 4 secured at an appropriate predetermined location on the equipment module support plate in such a way as to remain free to move in terms of translation in the direction of the edge face 2 of the door, the sleeves 51 of the connecting elements 5 being inserted in the slots, and the module support plate being in place, the control module 3 is offered up to the place intended for it in the exterior panel 1 and its bent L-shaped fingers 32 are inserted into the aperture in the exterior panel 1 then into the aperture in the intermediate mounting plate 4, arranging them beside the tabs 41 of the latter. The control module 3 is pressed against the exterior panel 1, clipping it in if need be and moving it in a translational movement in such a way that the inclined faces of the L-shaped fingers 32 come to partially face the tabs 41. The body of the screw 6 is introduced into the edge face 2 of the door and into the tapped hole in the intermediate mounting plate 4 and the screw is tightened causing the intermediate plate 4 to move towards the edge face 2 of the door. This, in turn, causes the control module 3 to be clamped against the door panel 1 and the ends 53 of the connecting elements 5 to become fastened.

It is also possible to provide watertightness using, for example, a seal inserted between the control module 3 and the door panel 1.

As an alternative (not depicted in the drawings), the intermediate mounting plate 4 is mounted stationary, for example bonded, on the equipment module support plate, and the locating element 42 comprises a separate support equipped with a baseplate with through-holes to take the connecting elements 5. Removable attachment members are provided for fixing the support to the control module 3, for example by clipping. The support may thus, for example, be produced in the form of a casing, one wall of which may be bent to form one or more clip-fastening or catching lugs. The outside opening control module 3 is then clamped in place utilizing a screw, also inserted into the edge face 2 of the door.

However, the invention is not restricted to the embodiments described hereinabove, and other embodiments could be provided without departing from its scope.

What is claimed is:

1. A vehicle door including:

a door having an exterior door panel having a door aperture, and a door edge face positioned perpendicular to the exterior door panel, and an equipment module having a support plate and connecting elements supported by the support plate comprising;

an outside opening control module for opening the door from outside the vehicle and an attachment component on an inside surface thereof;

an intermediate mounting plate disposed between the module support plate and said exterior door panel and having an attachment cooperating component for cooperating with the attachment component of the outside opening control module to secure the outside opening control module to the exterior door panel at the door aperture, the intermediate mounting plate further having a location element for positioning the connecting elements so as to enable connection of said outside opening control module to a lock; and said intermediate mounting plate comprises a peripheral region forming a closed contour for an aperture for receiving at least part of the outside opening control module while at least another part of the outside opening control module extends on the outside of the exterior door panel of the vehicle door.

2. The door as recited in claim 1 wherein the attachment component includes a plurality of fingers and wherein the attachment cooperating component includes a plurality of corresponding tabs wherein the outside opening control module is clipped to the intermediate mounting plate.

3. The door as recited in claim 2 wherein the corresponding tabs extend from the peripheral region of the intermediate mounting plate and project towards the inside of the aperture.

4. The door as recited in claim 3 wherein each of the plurality of fingers include a base portion mounted on the inside surface of the outside opening control module and a tip portion extending perpendicularly from the base portion, and each of the plurality of fingers has an inside face facing the interior surface of the outside opening control module and an outside face facing the inside of the door, the inside face of each of the fingers being inclined at an increasing angle from the tip portion to the base portion, and wherein each of the corresponding tabs has an inside face facing the inside of the door and an outside face facing outside the door, the inclined inside faces of the fingers for mating with the corresponding inside faces of the tabs so that the intermediate mounting plate is held in one and the same plane and is capable of moving only in this plane while the outside opening control module is prevented from moving in the same direction as the intermediate mounting plate, the movement of the intermediate mounting plate in at least one predetermined direction leads to a movement of that part of the outside opening control module which is outside the exterior door panel in the direction of the plane of the intermediate mounting plate and causes it to be gripped tightly against the exterior panel.

5. The door as recited in claim 1 wherein the connecting elements comprise at least one rod.

6. The door as recited in claim 1 including a key-operated component.

7. The door as recited in claim 1, wherein the attachment cooperating component on said intermediate mounting place extending inwardly of said door aperture, such that the attachment component of said outside opening control module and said attachment cooperating component on said intermediate mounting plate being connected within said door aperture.

8. The door as recited in claim 1, wherein said intermediate mounting plate having plural attachment cooperating components and said outside opening control module having plural attachment components formed at upper and lower portions within said door aperture.

9. A vehicle door including:

a door having an exterior door panel having a door aperture, and a door edge face positioned perpendicular to the exterior door panel comprising:

an outside opening control module for opening the door from outside the vehicle and an attachment component on an inside surface thereof;

an intermediate mounting plate disposed between a module support plate and said exterior door panel and having an attachment cooperating component for cooperating with the attachment component of the outside opening control module to secure the outside opening control module to the exterior door panel at the door aperture, the intermediate mounting plate further having a location element for positioning connecting elements so as to enable connection of said outside opening control module to a lock; and the door further comprises a screw having a head portion and a body portion, the body portion passing through the door edge face and cooperating wit a tapped thread portion in the intermediate mounting plate.

10. The door as recited in claim 9 wherein the intermediate mounting plate has a lug extending at right angles to the plane of the intermediate mounting plate having the tapped thread portion tat cooperates with the body portion of the screw.

11. The door as recited in claim 9 wherein the screw extends along a central axis parallel to the plane of the intermediate mounting plate, and wherein turning of the screw causes the intermediate mounting plate to move in a direction of the head portion of the screw and the outside opening control module to be tightly gripped against the exterior door panel.

12. A vehicle door including:

a door having an exterior door panel having a door aperture, and a door edge face positioned perpendicular to the exterior door panel comprising:

an outside opening control module for opening the door from outside the vehicle and an attachment component on an inside surface thereof;

an intermediate mounting plate disposed between a module support plate and said exterior door panel and having an attachment cooperating component for cooperating with the attachment component of the outside opening control module to secure the outside opening control module to the exterior door panel at the door aperture, the intermediate mounting plate further having a location element for positioning connecting elements so as to enable connection of said outside opening control module to a lock; and the location element comprises an element support in the form of a lug of the intermediate mounting plate, extending at right angles to the plane of the intermediate mounting plate, and having slots to receive the connecting elements.

13. The door as recited in claim 12 wherein the connecting elements have a sleeve having a groove formed on the outside thereof for securing the connecting elements to the location element.

14. A vehicle door including;

a door having an exterior door panel having a door aperture, and a door edge face positioned perpendicular to die exterior door panel comprising:

an outside opening control module for opening the door from outside the vehicle and an attachment component on an inside surface thereof;

an intermediate mounting plate disposed between a module support plate and said exterior door panel and having an attachment cooperating component for cooperating with the attachment component of the outside opening control module to secure the outside opening control module to the exterior door panel at the door aperture, the intermediate mounting plate further having a location element for positioning connecting elements so as to enable connection of said outside opening control module to a lock; and the connecting elements comprise at least one flexible cable.

* * * * *

UNITED STATES PATENT AND TRADEMARK OFFICE

CERTIFICATE OF CORRECTION

PATENT NO. : 6,490,894 B1
DATED : December 10, 2002
INVENTOR(S) : Arquevaux

It is certified that error appears in the above-identified patent and that said Letters Patent is hereby corrected as shown below:

Column 6,
Line 14, “tat” should read -- that --.
Line 51, “die” should read -- the --.

Signed and Sealed this

Third Day of June, 2003

JAMES E. ROGAN
*Director of the United States Patent and Trademark Office*